US005323171A

United States Patent [19]

Yokouchi et al.

[11] Patent Number: 5,323,171

[45] Date of Patent: Jun. 21, 1994

[54] POWER CIRCUIT

[75] Inventors: Hideaki Yokouchi; Tatsuo Nishimaki, both of Nagano, Japan

[73] Assignee: Seiko Epson Corporation, Tokyo, Japan

[21] Appl. No.: 119,884

[22] Filed: Sep. 10, 1993

Related U.S. Application Data

[63] Continuation of Ser. No. 640,422, Mar. 8, 1991, abandoned.

[30] Foreign Application Priority Data

May 26, 1989 [JP] Japan ..... 1-133019
May 26, 1989 [JP] Japan ..... 1-133020
May 11, 1990 [JP] Japan ..... 2-122606

[51] Int. Cl.[5] ..... G09G 3/34

[52] U.S. Cl. ..... 345/94; 345/211; 361/92

[58] Field of Search ..... 361/18, 91, 92; 323/311; 368/64, 242, 84, 72, 73, 66; 345/94, 95, 87, 211

[56] References Cited

U.S. PATENT DOCUMENTS 4,015,420 4/1977 Walker ..... 368/64 X
4,371,269 2/1983 Sutter ..... 368/66 X
4,433,401 2/1984 Shida et al. ..... 368/66 X
4,529,322 7/1985 Ueda ..... 368/64 X

FOREIGN PATENT DOCUMENTS 0125683 10/1981 Japan ..... 368/64
0153885 12/1981 Japan ..... 368/64
59-38558 9/1984 Japan .
63-15560 4/1988 Japan .
63-27747 11/1988 Japan .
2061645 5/1981 United Kingdom .
2078021 11/1981 United Kingdom .
2079498 1/1982 United Kingdom .

*Primary Examiner*—Ulysses Weldon
*Attorney, Agent, or Firm*—Ladas & Parry

[57] ABSTRACT

A power source circuit consisting of a combination of a constant-voltage circuit (1) and a voltage raising/lowering circuit (2) which produces a plurality of output voltages by raising or lowering the output of the constant-voltage circuit. When a change in the power source voltage or the presence or absence of a heavy load is detected that information is supplied as a control mode signal to both the circuit (1) and circuit (2). For instance, when the power source voltage is reduced or when a heavy load is driven, the output voltage of the circuit (1) lowered and instead the rate of change in the output voltage of the circuit (2) is adjusted so that the output voltage may eventually become the same as in steady state.

4 Claims, 4 Drawing Sheets

POWER CIRCUIT

This is a continuation of copending application Ser. No. 07/640,422 filed on Mar. 8, 1991 now abandoned and International Application PCT/JP90/00672 filed on May 25, 1990 and which designated the U.S.

TECHNICAL FIELD

The present invention relates to a power circuit, such as a power circuit for use in a liquid crystal display apparatus, for supplying a plurality of different value output voltages to a load, and particularly relates to a countermeasure at the voltage drop in the source voltage.

BACKGROUND ART

For example, a conventional power circuit for a liquid crystal display circuit has been constituted by a constant-voltage circuit for sending out a constant output voltage independently of variation of a source voltage, and a boosting/dropping circuit for boosting/dropping the output voltage of the constant-voltage circuit to thereby send out a plurality of different value output voltages, thereby supplying these output voltages as driving voltages to a liquid crystal display panel to drive it.

It is however impossible for such a conventional power circuit for a liquid crystal display circuit to maintain the quality of liquid crystal display with a low power consumption over a wide range of the source voltage.

For example, assume a case where the liquid crystal display panel needs voltages of five values 0 V, 1 V, 2 V, 3 V and 4 V. In a case where a liquid crystal driving voltage of 2 V is generated in the constant-voltage circuit and liquid crystal driving voltages of 1 V, 3 V and 4 V are generated with this 2 V liquid crystal driving voltage as a reference by the boosting/dropping circuit, the constant-voltage circuit becomes impossible to generate the 2 V liquid crystal driving voltage when the source voltage becomes lower than 2 V, and as a result the boosting/dropping circuit becomes impossible to generate the above-mentioned liquid crystal driving voltages. Therefore there is a problem that the liquid crystal driving voltages drop correspondingly to the drop of the source voltage so that the contrast of the liquid crystal display deteriorates.

In a case where a liquid crystal driving voltage of 1 V is generated in the constant-voltage circuit and liquid crystal driving voltages of 2 V, 3 V and 4 V are generated by the boosting/dropping circuit, the quality of display of the liquid crystal panel can be ensured till the source voltage drops to 1 V. There is however a problem that the loss of charges due to charging and discharging of capacitors is so large that current consumption becomes large to thereby shorten the life of a battery constituting a power source.

DISCLOSURE OF INVENTION

It is an object of the present invention to provide a power circuit which can suitably cope with the change of the source voltage, particularly the drop of the source voltage, and prevent the current consumption from increasing.

A power circuit according to the present invention includes a constant-voltage circuit for outputting a voltage corresponding to a predetermined mode control signal, and a boosting/dropping circuit for boosting/dropping the output voltage of the constant-voltage circuit at rates based on the predetermined mode control signal so as to send out a plurality of different output voltages. The output of this constant-voltage circuit and/or the boosting/dropping circuit is supplied to a load, for example, as liquid crystal driving voltages, to a liquid crystal driving circuit for driving a liquid crystal display panel.

Here, as means for producing the predetermined mode control signal, there is a source voltage judgment circuit or a heavy-load detection circuit. The source voltage judgment circuit compares the source voltage with a predetermined reference voltage and outputs a mode control signal corresponding to the comparison result.

For example, if the judgment proves that the source voltage is equal to or higher than the reference voltage, a mode control signal corresponding this result is supplied to the constant-voltage circuit and the boosting/dropping circuit. The constant-voltage circuit outputs a high voltage corresponding to this mode control signal, and the boosting/dropping circuit boosts/drops the high output voltage at predetermined rates so as to output a plurality of voltages.

On the contrary, if the judgment proves that the source voltage is lower than the reference voltage, the constant-voltage circuit outputs a low voltage corresponding to a mode control signal at that time, and the boosting/dropping circuit boosts/drops the high output voltage at rates different from the above-mentioned rates so as to output a plurality of voltages. The outputs of the constant-voltage circuit and the boosting/dropping circuit at this time is the same as a whole as that in the case where the judgment proves that the source voltage is equal to or higher than the reference voltage.

On the other hand, since a load connected to a power source is known in advance, when a load corresponding to a heavy load is to be driven, the heavy-load detection circuit outputs a mode control signal corresponding the heavy load. That is, since the current consumption when a heavy load is driven is large so that it is inevitable that the voltage drop caused by the internal resistance of the power source or battery becomes large to thereby lower the source voltage, the same processing as in the case where the source voltage has dropped is performed not after detecting the source voltage dropping as mentioned above, but before the source voltage drops actually.

According to the present invention, therefore, the output of a constant-voltage circuit is made high when the source voltage becomes high, and when the source voltage becomes low or a heavy load is driven, on the contrary, the output of the constant-voltage circuit is made low and the rates of boosting/dropping of the boosting/dropping circuit is made different from that in the above-mentioned case to thereby make the voltages to be supplied to the load same. Accordingly, it is possible to drive the load stably regardless of the change of the source voltage. In addition, the constant-voltage circuit outputs a low voltage only when the source voltage is low or a heavy load is driven, and in the case other than the above case, it outputs a high voltage so that it is possible to drive a load with a low power consumption as a whole so as to prolong the life of a power source when a battery is used as the power source.

BEST MODE FOR CARRYING OUT THE INVENTION

Figure 1:
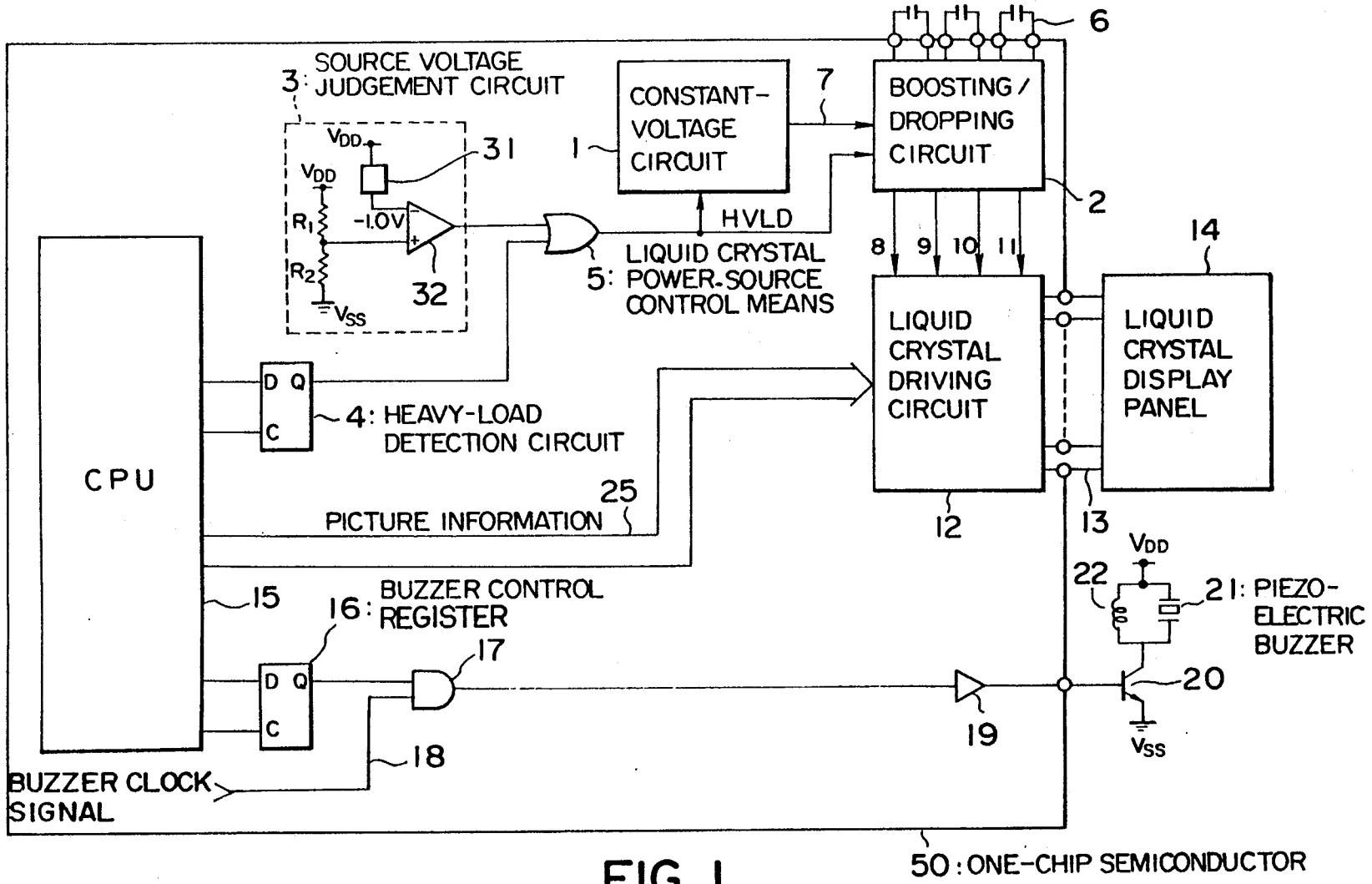
FIG. 1 is a block diagram illustrating an example in which an embodiment of the power circuit according to the present invention is used as a driving power source for a liquid crystal display panel.

A power source for driving a liquid crystal display panel shown in FIG. 1 is built in a one-chip semiconductor 50, and a constant-voltage circuit 1 has a mode for outputting 1 V and a mode for outputting 2 V. A boosting/dropping circuit 2 has a capacitor 6 in its exterior for charging and discharging charges to boosting and dropping an output 7 of the constant-voltage circuit 1. When the output 7 of the constant-voltage circuit 1 is 2 V, the boosting/dropping circuit 2 drops the output 7 of the constant-voltage circuit 1 to supply 1 V to an output terminal 8, and boosts the output 7 of the constant-voltage circuit 1 to supply 3 V and 4 V to output terminals 10 and 11 respectively. At this time, the same electric potential 2 V as the constant-voltage circuit output 7 is supplied to an output terminal 9.

Here, "1 V", "2 V", "3 V" and "4 V" indicate absolute values, while, for example, if a positive pole is made to be an earth potential, they indicate negative values.

On the other hand, when the output 7 of the constant-voltage circuit 1 is 1 V, the boosting/dropping circuit 2 boosts the output 7 of the constant-voltage circuit 1 to supply 2 V, 3 V and 4 V to the output terminals 9, 10 and 11 respectively, and the same electric potential 1 V as the output 7 of the constant-voltage circuit 1 is supplied to the output terminal 8.

A source voltage judgment circuit 3 judges whether the source voltage is higher than 2 V or lower. This source voltage judgment circuit 3 divides the source voltage through resistors R1 and R2 as illustrated, compares the divisional potential with a reference voltage of a reference voltage generating circuit 31 by means of a comparison circuit 32, and outputs the comparison result.

A heavy-load detection circuit 4 detects the operation of the operation of a heavy-load circuit, such as an externally provided buzzer, when it operates. Here, such a heavy-load circuit is described. A CPU section 15 writes "1" into a terminal D of a buzzer control register 16 when a predetermined load, which is a buzzer here, is actuated. The output of the buzzer control register 16 opens an AND gate 17 so that a buzzer clock signal 18 is send out through the AND gate 17. This buzzer clock signal 18 usually has a frequency from 2 kHz to 8 kHz, and makes a piezo-electric buzzer 21 buzz through a buzzer driver 19 and a transistor 20. Since the acoustic pressure of the piezo-electric buzzer 21 will be small if source voltage (voltage between $V_{DD}$ and $V_{SS}$) is low, a boosting coil 22 connected with the piezo-electric buzzer 21 in parallel boosts the voltage applied to the piezo-electric buzzer 21 by use of counter electromotive force of its inductance, thereby making the acoustic pressure of the piezo-electric buzzer 21 large. Since a current of several mA flows when this piezo-electric buzzer 21 is buzzing, if the internal impedance of a battery is high, for example, if the battery is worn out, the output voltage of the battery drops because of the voltage drop caused by the internal impedance of the battery.

Therefore, when a heavy load is driven, for example, when a buzzer is actuated to buzz, "1" is written through the CPU section 15 into a terminal D of a heavy-load mode setting register constituting the heavy-load detection circuit 4, so that the heavy-load detection circuit 4 sends out its output which has been made to be "1". Of course, at the time of stopping the driving of the buzzer, it is necessary to write "0" into the heavy-load mode setting register to make its mode return to a normal mode.

A liquid crystal power source control means 5 is constituted by an OR circuit so that the respective outputs of the source voltage judgment circuit 3 and the heavy-load detection circuit 4 are ORed so that a mode control signal is supplied to the constant-voltage circuit 1 and the boosting/dropping circuit 2.

For example, when the source voltage judgment circuit 3 proves that the source voltage is higher than 2 V, the liquid crystal power source control means 5 makes the output of the constant-voltage circuit 1 be 2 V and brings the operation of the boosting/dropping circuit 2 into a [1 V dropping || 3 V and 4 V boosting] mode, while if the source voltage judgment circuit 3 proves that the source voltage is lower than 2 V, the liquid crystal power source control means 5 switches the output of the constant-voltage circuit 1 into 1 V and switches the operation of the boosting/dropping circuit 2 into a [2 V, 3 V and 4 V boosting] mode.

In normal operation, that is, at the time of a not-heavy load, according to the mode control signal supplied from the heavy-load detection circuit 4, the liquid crystal power source control means 5 makes the output of the constant-voltage circuit 1 be 2 V and brings the operation of the boosting/dropping circuit 2 into the [1 V dropping || 3 V and 4 V boosting] mode, while in heavy-load operation, the liquid crystal power source control means 5 switches the output of the constant-voltage circuit 1 into 1 V and switches the operation of the boosting/dropping circuit 2 into the [2 V, 3 V and 4 V boosting] mode.

A liquid crystal driving circuit 12 is supplied with liquid crystal driving voltages 1 V, 2 V, 3 V and 4 V from the boosting/dropping circuit 2 and supplied with picture information 25 from the CPU section 15, so that the liquid crystal driving circuit 12 selects desired liquid crystal driving voltage on the basis of the picture information 25 to supply a liquid crystal display signal 13 to a liquid crystal display panel 14 which displays a picture on the basis of the liquid crystal display signal 13.

Figure 2:
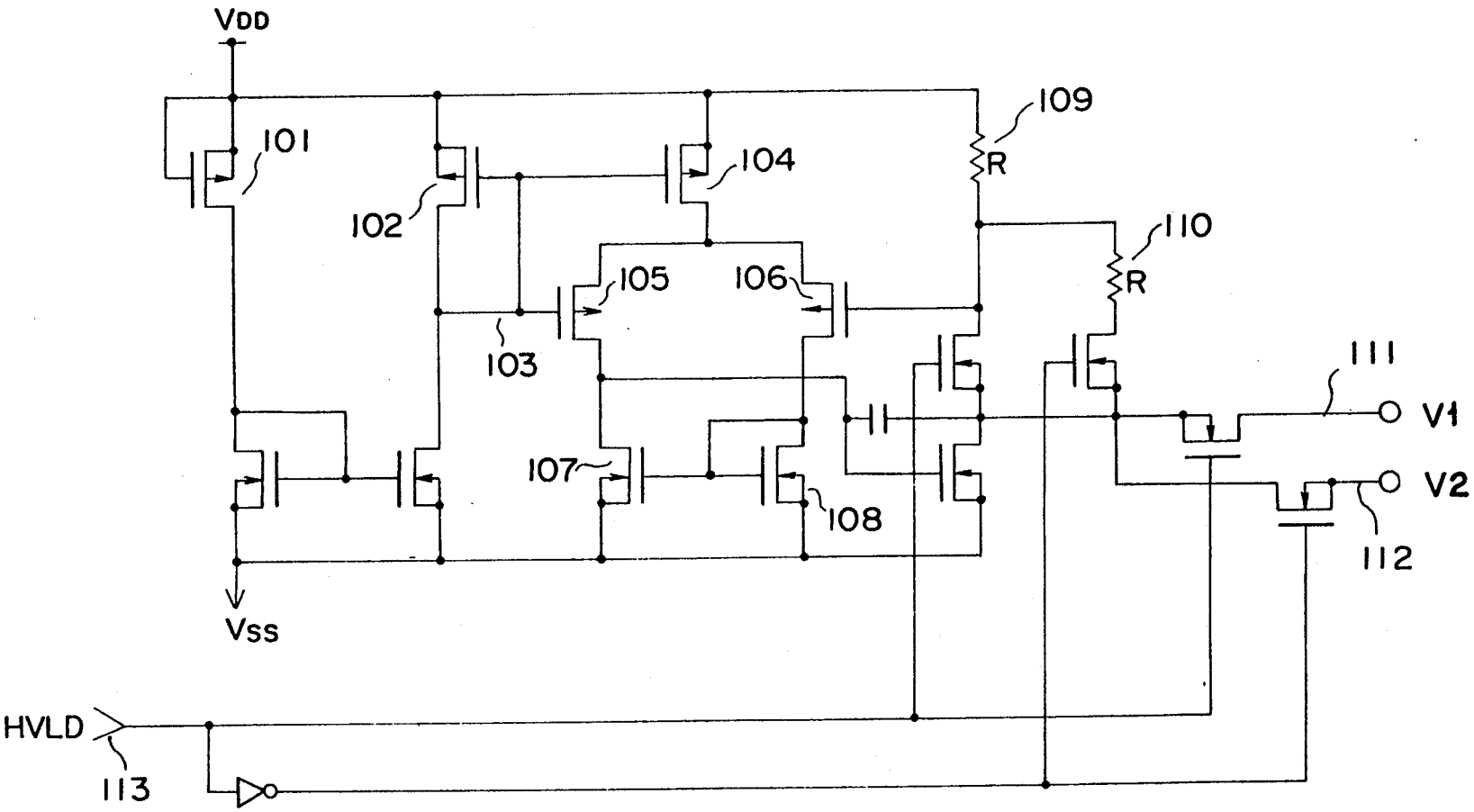
FIG. 2 is a circuit diagram of a constant-voltage circuit in the above-mentioned embodiment.

FIG. 2 is a circuit diagram illustrating an example of the constant-voltage circuit 1.

The difference between the threshold voltages of PMOS-FETs 101 and 102 is outputted as a reference voltage at a connection point 103. Here, the PMOS-FET 101 is a depletion-type FET, and the PMOS-FET 102 is an enhancement-type FET. In the case where the difference between the threshold voltages of the PMOS-FETs 101 and 102 is made up by the work function difference between poly-silicon gates, it is possible to generate about 1 V stably. Then, the reference voltage at the connection point 103 is outputted as a constant voltage relative to $V_{DD}$. Five MOS-FETs 104 to 108 are differential amplifier circuits composed of operational amplifiers, and constitute a differential buffer circuit.

A mode control signal HVLD 113 is a signal for controlling an output mode of the constant-voltage circuit 1, and if HVLD is LOW, the reference voltage is amplified through feedback resistors 109 and 110 so that the voltage twice as high as the reference voltage is outputted as V2 through a terminal 112. If HVLD is HIGH, on the contrary, the voltage having the same potential as the reference voltage is outputted as V1 through a terminal 111.

In such a case where the reference voltage is set to −1 V relative to $V_{DD}$ (zero potential), −2 V is outputted to V2 when HVLD is LOW, while −1 V is outputted to V1 when HVLD is HIGH.

Figure 3:
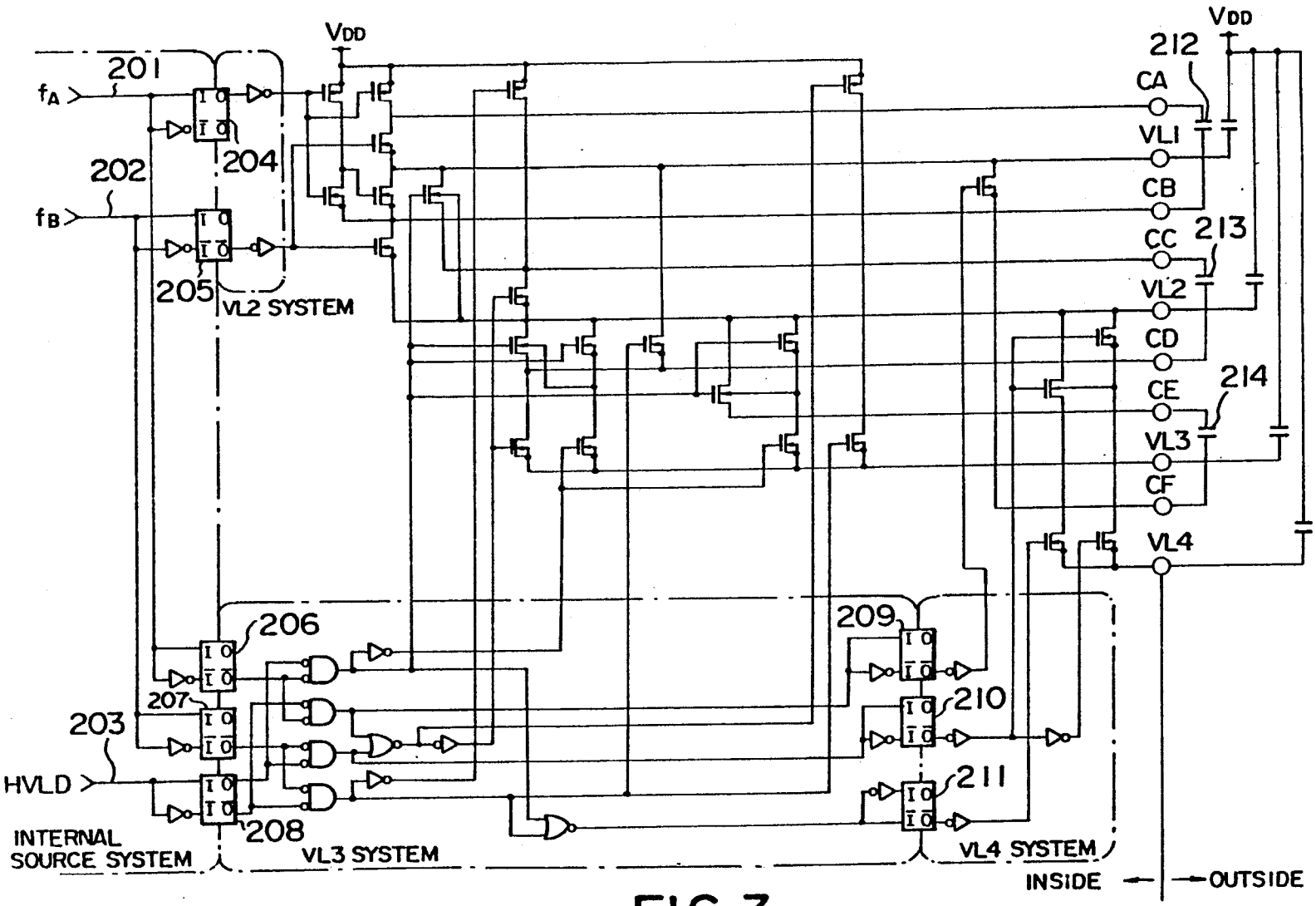
FIG. 3 is a circuit diagram of a boosting/dropping circuit in the above-mentioned embodiment.
Figure 4:
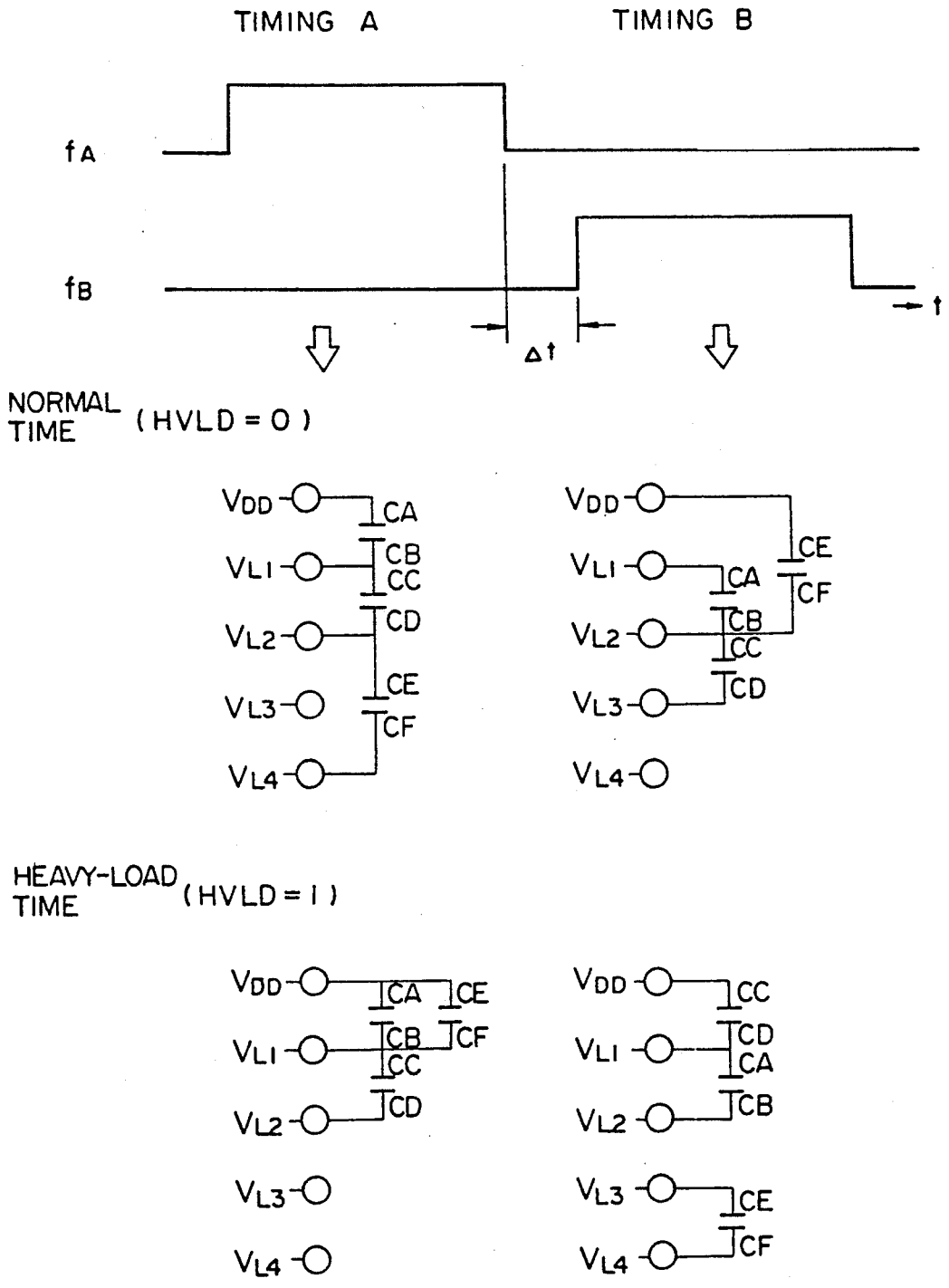
FIG. 4 is an operation explanation diagram of the boosting/dropping circuit of FIG. 3.

FIG. 3 is a circuit diagram illustrating an example of the boosting/dropping circuit 2. $f_A$ and $f_B$ at 201 and 202 are clock signals, the timing chart of which is shown in FIG. 4. Then, in order to prevent charging/discharging timing from overlying, a time difference Δt is provided between the leading edge of the clock signal $f_A$ and the trailing edge of the clock signal $f_B$. Level converters 204, 205, 206, 207, 208, 209, 210 and 211 constitute level conversion circuits for converting control signals including the above-mentioned clock signals into signals having larger amplitudes.

In this boosting/dropping circuit 2, the boosting/dropping operation is realized by changing the connection state between charge transfer capacitors (212, 213 and 214 in FIG. 3) and the power source terminals from $V_{DD}$ to VL4, at the timing when the clock signal $f_A$ is HIGH as well as the clock signal $f_B$ is LOW, and at the timing when which $f_A$ is LOW as well as $f_B$ is HIGH.

When HVLD is LOW:

VL1 is generated by dropping VL2 by ½;

VL3 is generated by boosting VL2 by 1.5 fold; and

VL4 is generated by boosting VL2 by 2 fold.

When HVLD is HIGH, on the contrary:

VL2 is generated by boosting VL1 by 2 fold;

VL3 is generated by boosting VL1 by 3 fold; and

VL4 is generated by boosting VL1 by 4 fold.

The connection states of the transfer capacitors in the respective modes are shown in FIG. 4.

The liquid crystal power source control means 5 may be arranged so as to receive the output from the source voltage judgment circuit 3 or the output of the heavy-load detection circuit 4 directly to thereby control a liquid crystal power source, or so as to control the liquid crystal power source with software by means of a microcomputer or the like.

Although an example in which a D-type flip flop circuit is used for the heavy-load detection circuit 4 has been shown in the above-mentioned embodiment, another type flip flop circuit may be used, or a flip flop circuit constituting the buzzer control register 16 in a buzzer circuit may be used as it is.

INDUSTRIAL APPLICABILITY

The present invention can be applied not only to a power circuit for a liquid crystal display means but also to a power circuit which is required to output multilevel voltages by combination of a constant-voltage circuit and a boosting/dropping circuit.

We claim:

1. A Power Circuit comprising:

a source voltage judgement circuit for comparing a source voltage with a predetermined reference voltage and for generating a first mode control signal corresponding to the result of the comparison:

a CPU for generating a second mode control signal when a predetermined externally provided load is driven;

a heavy-load register coupled to said CPU and for setting said second mode control signal thereinto;

an OR circuit for making an OR operation on said first mode control signal from said source voltage judgement circuit and said second mode control signal set in said heavy load register and for generating a resultant mode control signal;

a constant voltage circuit coupled to said OR circuit for outputting a voltage corresponding to said resultant mode control signal from said OR circuit; and a boosting/dropping circuit for receiving the output voltage of said constant voltage circuit and for boosting/dropping the source voltage at rates based on said resultant mode control signal from said OR circuit to thereby generate a plurality of output voltages.

2. A power circuit according to claim 1 for use as a power circuit for a liquid crystal display apparatus, comprising said CPU for outputting picture information, and a liquid crystal display driving circuit supplied with the output voltages from said boosting/dropping circuit as liquid crystal driving voltages and further supplied with the picture information from said CPU, whereby supply a display signal to an externally provided liquid crystal display panel.

3. A power circuit according to claim 1, in which said source voltage judgement circuit, said OR circuit, said constant voltage circuit and said boosting/dropping circuit are constituted by a one-chip semiconductor device.

4. A power circuit according to claim 3, and further comprising a capacitor coupled by external terminals to said boosting/dropping circuit.

* * * * *